United States Patent [19]

Clavin

[11] 4,027,522

[45] June 7, 1977

[54] INTERNAL MANDREL FOR USE IN BENDING THE ENDS OF PIPES

[75] Inventor: Edward A. Clavin, Houston, Tex.

[73] Assignee: Midcon Pipeline Equipment Co., Houston, Tex.

[22] Filed: Nov. 14, 1975

[21] Appl. No.: 631,883

[52] U.S. Cl. ..... 72/466; 72/392; 269/48.1

[51] Int. Cl.[2] ..... B21B 25/00; B21D 9/00

[58] Field of Search ..... 72/369, 466, 701, 392, 72/393; 82/44; 29/200 B, 200 P, 272; 269/48.1; 279/2; 228/50

[56] References Cited

UNITED STATES PATENTS

| | | | |
|---|---|---|---|
| 2,156,651 | 5/1939 | Gardiner | 29/272 |
| 2,823,634 | 2/1958 | Barth | 269/48.1 |
| 3,043,361 | 7/1962 | Kelso | 72/466 X |
| 3,109,477 | 11/1963 | Avera et al. | 269/48.1 X |

FOREIGN PATENTS OR APPLICATIONS

| | | | |
|---|---|---|---|
| 741,176 | 11/1955 | United Kingdom | 269/48.1 |

*Primary Examiner*—Robert Louis Spruill
*Attorney, Agent, or Firm*—Carl B. Fox, Jr.

[57] ABSTRACT

Internal mandrel for use in bending the ends of pipes, wherein a hydraulic cylinder actuates a system of levers and toggles to apply force across the interior of an end of a pipe in the direction in which the pipe is to be bent to prevent distortion and collapse of the pipe during bending adjacent to its ends.

19 Claims, 3 Drawing Figures

INTERNAL MANDREL FOR USE IN BENDING THE ENDS OF PIPES

BACKGROUND OF THE INVENTION

In the bending of relatively large diameter pipe, bending machines are used wherein the pipe is supported upon a die or support called the holding shoe at one end beneath an upper bending die which is supported in fixed position above the pipe. A movable die called the strongback supports the pipe at the other end of the bending die. The strongback is moved pivotally upward to bend the pipe against the convexly curved lower surface of the bending die.

An internal expandable mandrel is disposed within the pipe to prevent pipe distortion and collapse during bending. The internal mandrel, because of its size and structure, cannot be positioned close to the end of a pipe to be bent, and when the pipe is bent adjacent to one of its ends the pipe end may become distorted or collapsed to an out of round condition.

SUMMARY OF THE INVENTION

The present invention provides an apparatus for use to prevent distortion and collapse of the end of a pipe when a bend is made close to the pipe end. Use of the apparatus will also enable the pipe to be bent closer to one or both of its ends than has heretofore been done. The apparatus is operated by a hydraulic cylinder acting through a system of levers and toggles to expand within the pipe end to exert force across the end of the pipe to prevent distortion and collapse of the pipe end during bending. The apparatus is carried to a position at the pipe end by a ground vehicle or by a hoisting apparatus such as a crane, and is inserted into the end of the pipe in unexpanded condition. The apparatus is then expanded to support the pipe wall at the end of the pipe in the direction of the bend before formation of the bend is commenced. After the bend has been completed, the apparatus is retracted and removed form the end of the pipe.

The mandrel apparatus is of relatively simple construction and operation, yet is entirely dependable and effective in use.

A principal object of the invention is to provide an internal pipe bending mandrel for use to support an end of a pipe during bending of the pipe adjacent its ends. Another object of the invention is to provide such an apparatus which is relatively simple in structure and operation, yet which is reliable and effective in use. A further object of the invention is to provide such mandrel apparatus which is actuated by operation of a cylinder acting through a system of levers and toggles to be expandable to support opposite sides of the wall of the pipe, and to be retractable for introduction into and removal from the end of the pipe.

Other objects and advantages of the invention will appear from the following detailed description of preferred embodiments thereof, reference being made to the accompanying drawings.

BRIEF DESCRIPTIONS OF THE DRAWINGS

DESCRIPTION OF THE PREFERRED EMBODIMENTS

Figure 2:
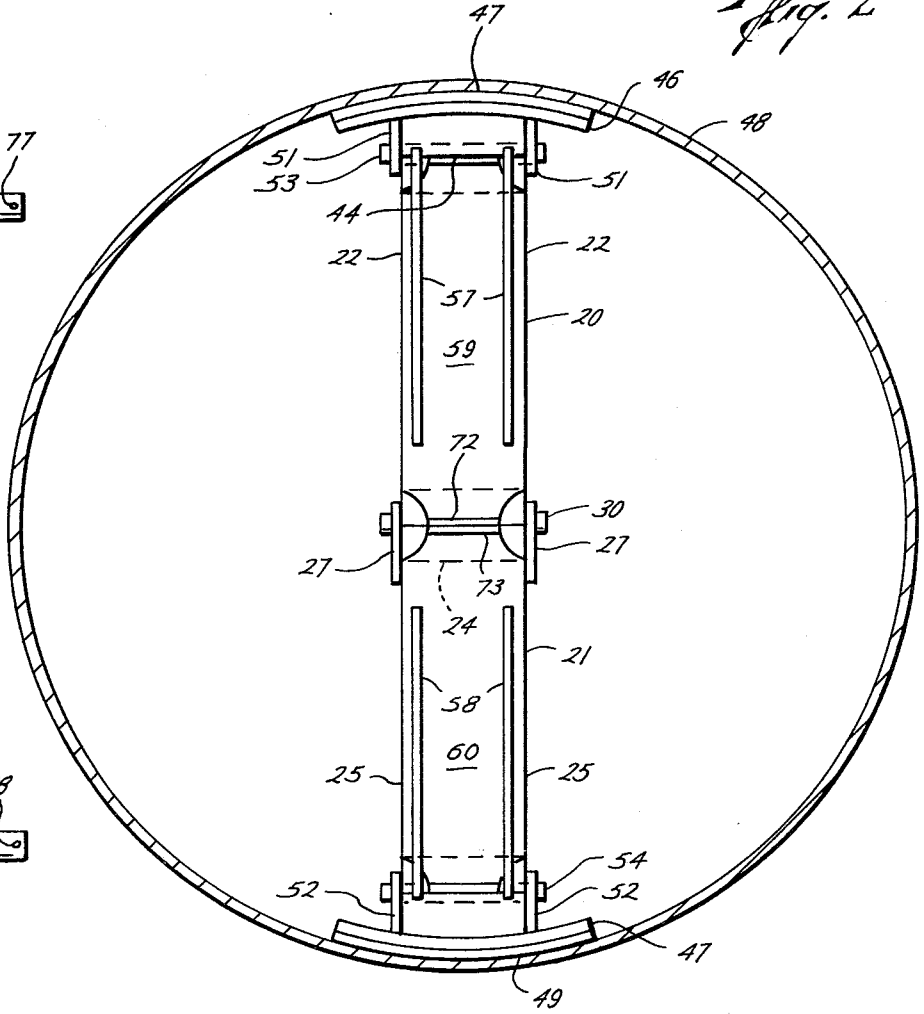
FIG. 2 is an end elevation of the apparatus shown in FIG. 1.
Figure 1:
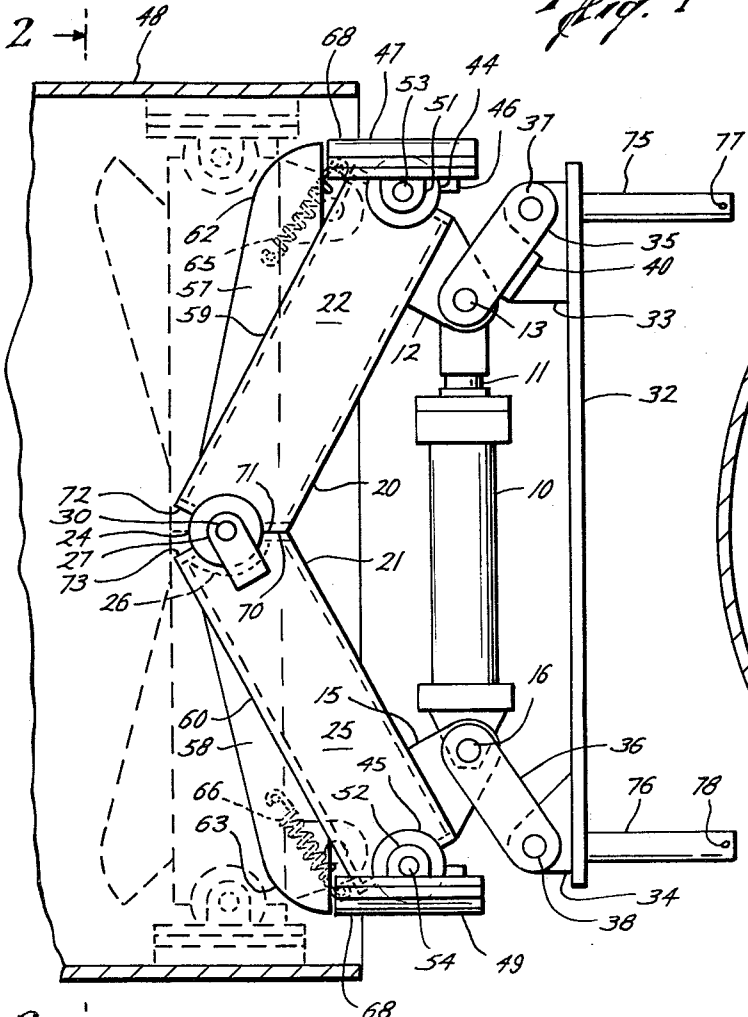
FIG. 1 is a side elevation, partly in vertical cross section, of a preferred embodiment of apparatus according to the invention.

Referring to the drawings, and describing the preferred embodiments of apparatus shown therein, the apparatus shown in FIGS. 1 and 2 includes a cylinder 10, which may be a hydraulic or preumatic cylinder, the shaft 11 of which is connected at its upper end to brackets 12 by a pivot pin 13, and connected at its lower end to brackets 15 by pivot pin 16. Brackets 12 and 15 are each a pair of brackets between which the shaft connection and lower end connection, respectively, of the cylinder 10 are received and connected.

Brackets 12 are connected by welding or in other suitable manner to the upper end of a toggle arm 20. Brackets 15 are similarly connected to the lower end of a toggle arm 21. The two toggle arms 20, 21 are pivotally connected together at their inner ends. Arms 20, 21 are each of circular tubular transverse cross section. Arm 20 has semicircular recesses in its opposite sides 22 at its lower end into which the upper part of a cylinder pivot bearing rod 24 is welded. Arm 21 has seimcircular recesses in its opposite sides 25 at its upper end around which an arcuate pivot bearing sleeve 26 is secured, and has a pair of arms 27 welded to the opposite sides 25 of its tubular body and extending past the center of the arc of bearing sleeve 26. Arms 27 and bearing rod 24 have aligned cylindrical openings therethrough which receive a cylindrical pin 30 which secures arms 20, 21 together.

A support plate 32 has brackets 33, 34 secured thereto at its upper and lower ends. Paired toggle connections 35, 36 are pivotally connected at one end to brackets 33, 34, respectively, by pivot pins 37, 38 and at their other ends to pins 13, 16, respectively. Bar 40 welded across bracket 33 engages arm 20 and limits the extent of retraction of arms 20, 21.

A cylindrical bearing 44 is welded into a semicylindrical recess in the upper end of toggle arm 20, and a cylindrical bearing 45 is welded into a semicylindrical recess in the lower end of toggle arm 21. Bearing blocks 46 have arcuate concave bearing surfaces mated respectively with bearings 44, 45. The upper bearing block 46 carries curved pad 47 adapted to engage the upper side of the wall of a pipe 48, and the lower bearing block 46 carries a pad 49 adapted to engage the lower side of the wall of pipe 48. The blocks 46 have brackets 51, 52 welded to their opposite sides and pins 53, 54, respectively, disposed through cylindrical holes through bearings 44, 45 and the respective brackets 51, 52, connect the pads to the bearings at the ends of arms 20, 21.

Guide plates 57, 58, there being two of each, are welded to the front sides 59, 60, respectively, of arms 20, 21. The guide plates are curved at their outer front edges 62, 63, respectively, for guiding the apparatus into the end of a pipe 48. Helical tension springs 65, 66 are connected between guide plates 57, 58 and the front sides of pads 47, 49 to maintain the front edges 68 of pads 47, 49 in inward positions behind the outer ends of guide plates 57, 58 during introduction of the apparatus into the pipe end, so that the pads will not be damaged during such introduction. As shown in FIG. 2, the outer sides of the pads 47, 49 are arcuately curved corresponding to the interior curvature of the pipe wall so as to flushly seat thereagainst.

The inner ends of arms 20, 21 are beveled at end plates 70, 71, respectively, at equal angles, whereby the end plates engage one against the other flushly when the apparatus is retracted, as depicted by solid lines in FIG. 1. The end plates 72, 73 of the arms 20, 21 are in flushly abutting dispositions when the arms are extended in aligned dispositions. End plates 70, 71 when engaged serve to limit the extent of retraction of the arms. End plates 72, 73 when engaged serve to prevent overtravel of arms 20, 21 beyond their fully extended positions.

Plate 32 has welded-on rods or bars 75, 76 having pin receiving holes 77, 78 adapted for connection to a lifting assembly (not shown) carried by a tractor (not shown) or other motive vehicle suitable for transporting the apparatus and for inserting the apparatus into the ends of pipes and for removing it after bending has been completed. The plate 32 and connections 75, 76 may take any suitable form consistent with their purposes.

Figure 3:
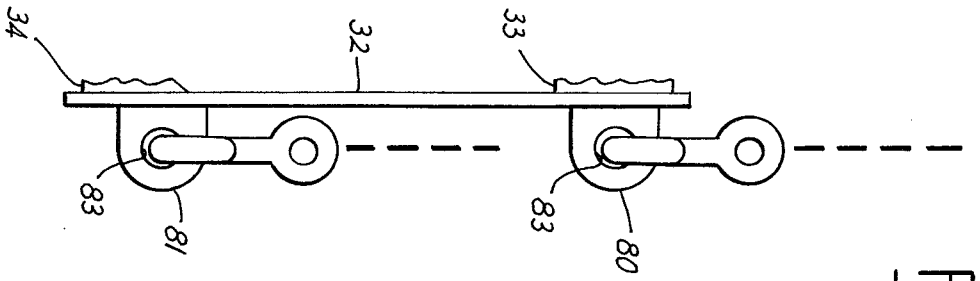
FIG. 3 is a partial side elevation showing a modified form of support for the apparatus.

For example, in FIG. 3 there is shown a variation of form of plate 32 wherein brackets 80, 81 are welded to plate 32, and have holes 83 for receiving hooks 84 of a chain or cable hoist (not shown). As stated, this portion of the apparatus may take any suitable form which all enable transportation of the apparatus and insertion of the apparatus into the end of a pipe and removal of the apparatus from the end of the pipe.

The apparatus is used during bending of a pipe, especially near its ends, in a manner which should by now be clear. Arms 20, 21 are inserted into the end of a pipe to be bent in retracted conditions, as shown by the solid line showing in FIG. 1. The plate 32 remains outside of the pipe. Cylinder 10, which is a hydraulic or pneumatic cylinder, and which is connected to a suitable pressured fluid source by suitable hoses (not shown), is then extended. Links 35, 36 are pivoted outwardly, as are arms 20, 21, this movement causing the spacing between pads 47, 49 to be increased whereby the pads will bear forcefully against the pipe wall at opposite sides thereof. During bending, the pipe is prevented from being reduced in diameter in the direction of arms 20, 21, and this prevents lateral spreading or bulging of the pipe sides during bending. After bending is completed, cylinder 10 is retracted and the apparatus is withdrawn from the end of the pipe.

While preferred embodiments of the apparatus have been described and shown in the drawings, many modifications thereof may be made by a person skilled in the art without departing from the spirit of the invention, and it is intended to protect by Letters Patent all forms of the invention falling within the scope of the following claims.

I claim:

1. Internal mandrel for use in bending pipes adjacent their ends, comprising a pair of arms each having pipe engagement means at its outer end, said arms being pivotally connected together at their inner ends and each having a laterally offset portion spaced from its inner end and said arms being movable between in line extended positions and retracted equal angular positions to one side of said in line positions, and actuator means connected between said laterally offset portions of said arms for moving said arms between said extended and retracted positions.

2. The combination of claim 1, said actuator means comprising cylinder means connected between portions of said arms spaced from their inner ends extendable to move said arms to said extended positions and retractable to move said arms to said retracted positions.

3. The combination of claim 2, including a vertical support, and including means linking said arms to said support whereby said arms are supported thereby.

4. The combination of claim 3, said support including means for connecting said support to an apparatus for lifting and handling said mandrel.

5. The combination of claim 3, said linking means comprising a pair of toggle link means each pivotally connected to said support at one end and each pivotally connected to a said arm at the other end.

6. The combination of claim 2, each said arm means having said pipe engagement means pivotally connected thereto at its outer end.

7. The combination of claim 6, each said pipe engagement means having an arcuately curved outer surface adapted to flushly seat against the inner side of the wall of a pipe to be bent.

8. The combination of claim 6, including guard means carried by each of said arm means adjacent a leading edge of said pipe engagement means for guiding the mandrel into the end of a pipe and for protecting said pipe engagement means during introduction of said mandrel into the end of a pipe.

9. The combination of claim 8, including means for restraining the leading edges of said pipe engagement means from pivotal movement from behind said guard means.

10. The combination of claim 9, the pivotal connections between the inner ends of said arm means and between the outer ends of said arm means and said pipe engagement means each comprising a cylindrical bearing rod affixed to one connected element and a cylindrical bearing socket formed in the other connected element, and means for retaining each said bearing rod seated in said bearing socket in which it is disposed.

11. The combination of claim 10, including means for limiting the retraction of said arm means.

12. The combination of claim 1, including a vertical support, and including means linking said arm means to said support whereby said arm means are supported thereby.

13. The combination of claim 12, said support including means for connecting said support to an apparatus for lifting and handling said mandrel.

14. The combination of claim 13, each said arm means having said pipe engagement means pivotally connected thereto at its outer end.

15. The combination of claim 14, each said pipe engagement means having an arcuately curved outer surface adapted to flushly seat against the inner side of the wall of a pipe to be bent.

16. The combination of claim 15, including guard means carried by each said arm means adjacent a leading edge of said pipe engagement means for guiding the mandrel into the end of a pipe and for protecting said pipe engagement means during introduction of said mandrel into the end of a pipe.

17. The combination of claim 16, including means for restraining the leading edges of said pipe engagement means from pivotal movements from behind said guard means.

18. The combination of claim 17, the pivotal connections between the inner ends of said arms and between the outer ends of said arms and said pipe engagement means each comprising a cylindrical bearing rod affixed to one connected element and a cylindrical bearing socket formed in the other connected element, and means for retaining each said bearing rod seated in said bearing socket in which it is disposed.

19. The combination of claim 18, including means for limiting the retraction of said arm means.

* * * * *